United States Patent [19]

Miyagawa et al.

[11] 4,346,289

[45] Aug. 24, 1982

[54] DEVICE FOR STOPPING SUCTION HEADS OF PAPER SHEET COUNTING APPARATUS AT DETERMINED ANGULAR POSITIONS

[75] Inventors: Tuyoshi Miyagawa; Hitoshi Manabe, both of Tokyo, Japan

[73] Assignee: Laurel Bank Machine Co., Ltd., Tokyo, Japan

[21] Appl. No.: 270,630

[22] Filed: Jun. 4, 1981

[30] Foreign Application Priority Data

Jun. 5, 1980 [JP] Japan ..... 55/78242[U]

[51] Int. Cl.[3] ..... G06M 9/02; B65H 3/12

[52] U.S. Cl. ..... 235/98 R; 271/9 S

[58] Field of Search ..... 235/98 R, 98 A, 98 B, 235/98 C; 271/9 S

[56] References Cited

U.S. PATENT DOCUMENTS 3,953,022 4/1976 Oshima ..... 235/98 R

*Primary Examiner*—L. T. Hix
*Assistant Examiner*—Thomas H. Tarcza
*Attorney, Agent, or Firm*—Fleit & Jacobson

[57] ABSTRACT

The device of the invention is assembled in a paper sheet counting apparatus to stop and held the suction heads at the predetermined positions at which one of the suction heads is precisely opposite to the face of the paper sheet in the face-to-face relationship. The suction heads are carried by a rotary cylinder having peripheral face on which a group of recesses each corresponding to each of the suction heads is formed. One of the recesses receives a pawl of a stopper when the rotary cylinder is stopped to terminate the paper sheet counting operation. The stopper is held at a retracted position when the counting operation is continued and moved to an engaging position when the one cycle counting operation is terminated. A slipping slope diverges from each recess outwards. The stopper is provided with an elongated hole in which a shaft is inserted, and the stopper is swinged about the shaft to be moved between the retracted position and the position to be engaged with one of the recesses. A spring is connected to the stopper to bias the stopper in one longitudinal direction with the shaft positioning at one extremity of the hole. In order to stop the rotary cylinder, the cylinder is rotated in the reverse direction, and the stopper is moved to the engaging position. Whereupon the pawl of the stopper slips down along the slipping slope to fall into one of the recesses. At that time, impact force is damped by the action of the bias spring.

2 Claims, 3 Drawing Figures

DEVICE FOR STOPPING SUCTION HEADS OF PAPER SHEET COUNTING APPARATUS AT DETERMINED ANGULAR POSITIONS

BACKGROUND OF THE INVENTION

1. Field of the Invention

The present invention relates to a device for stopping suction heads of a paper sheet counting apparatus at one of a plurality of predetermined angular positions when one cycle paper sheet counting operation is terminated. In such a paper sheet counting apparatus, paper sheets are successively sucked by the suction heads to be brought thereby from a stack station including a holder and a press roller separately one by one.

2. Prior Art

Generally in a paper sheet counting apparatus provided with suction heads, the sucking port of one of the suction heads shall be faced opposingly to the face of the stacked paper sheets to be ready for the next cycle counting operation after the preceding one cycle operation for counting an instructed number of paper sheets has been completed. In the conventional apparatus of this type, a plurality of equispaced engaging recesses corresponding to a plurality of the suction heads are provided on the peripheral face of a rotary cylinder on which said suction heads are carried, for example five equispaced recesses are provided on an entirely circular periphery. When one cycle counting operation is completed, a stopper having a latch or pawl which is to be engaged with or fitted into one of said recesses thereby to stop the rotary cylinder at a fixed angular position is swinged to a position for stopping the rotational movement of said rotary disk. The stopper is normally held at a retracted position with its latch or pawl being separated from either of said recesses.

However, in the aforementioned stopper device of the prior art, both of the stopper and the peripheral face of the rotary cylinder having said engaging recesses are made of the same or different metal and the disk is rotated in the reverse direction under a relatively high acceleration force, as one cycle counting operation has been completed and said rotary cylinder is rotated in order to engage said latch or pawl with one of the recesses. With such a construction, a loud crashing sound is generated when said pawl or latch of the stopper abuts against one of the recesses. Another disadvantage of the prior art device is that the contacting portions are rapidly abrased.

OBJECT AND SUMMARY OF THE INVENTION

The present invention is accomplished to overcome the disadvantages of the prior art device mentioned above.

Accordingly, a first object of the present invention is to provide a device for stopping the suction heads of a paper sheet counting apparatus at predetermined angular positions to be ready for immediately sucking the first sheet of the next counting operation, in which device the crashing sound generated by the corrision of the stopper onto the engaging recess of the rotary cylinder can be effectively suppressed.

Another object of the invention is to provide a device for stopping the suction heads of a paper sheet counting apparatus at predetermined positions to be ready for the next cycle counting operation, in which abrasion of the contacting portions can be prevented.

Further objects and features of the invention will become apparent from the following description of the presently preferred embodiments.

According to the present invention, there is provided a device for stopping the suction heads of a paper sheet counting apparatus at predetermined angular position to be ready for immediately sucking the first sheet of the next cycle counting operation, comprising a rotary cylinder carrying a group of suction heads and having a peripheral face provided with engaging recesses each corresponding to each one of said suction heads to determine the angular positions of said suction heads when one cycle paper sheet counting operation is terminated and the rotary disk is stopped, a stopper having a pawl to be engaged with one of said recesses to stop and fix said rotary cylinder during the standstill time when suction heads are to be stopped at predetermined angular position, said stopper having an elongated holes extending in the longitudinal direction thereof to receive a shaft about which said stopper is to be swinged, said stopper being movable relative to said shaft in the longitudinal direction within the extent defined by the length of said elongated hole, and a resilient member for damping the sliding movement of said stopper relative to said shaft when said pawl is engaged with one of said engaging recesses.

According to another aspect of the invention, the pawl or latch of the stopper, which is one of the contacting portions contacting or abutting under relatively high acceleration force, is made of a resilient but antifriction and abrasion-proof material such as hard synthetic resins or hard synthetic rubbers.

DESCRIPTION OF THE DRAWINGS

The advantages and features of the present invention will be more fully understood by reading the description relating to preferred embodiments of the invention while referring to the appended drawings in which.

DESCRIPTION OF THE PRESENTLY PREFERRED EMBODIMENTS

The present invention will now be described with reference to the drawings showing the presently preferred embodiments thereof.

Figure 1:
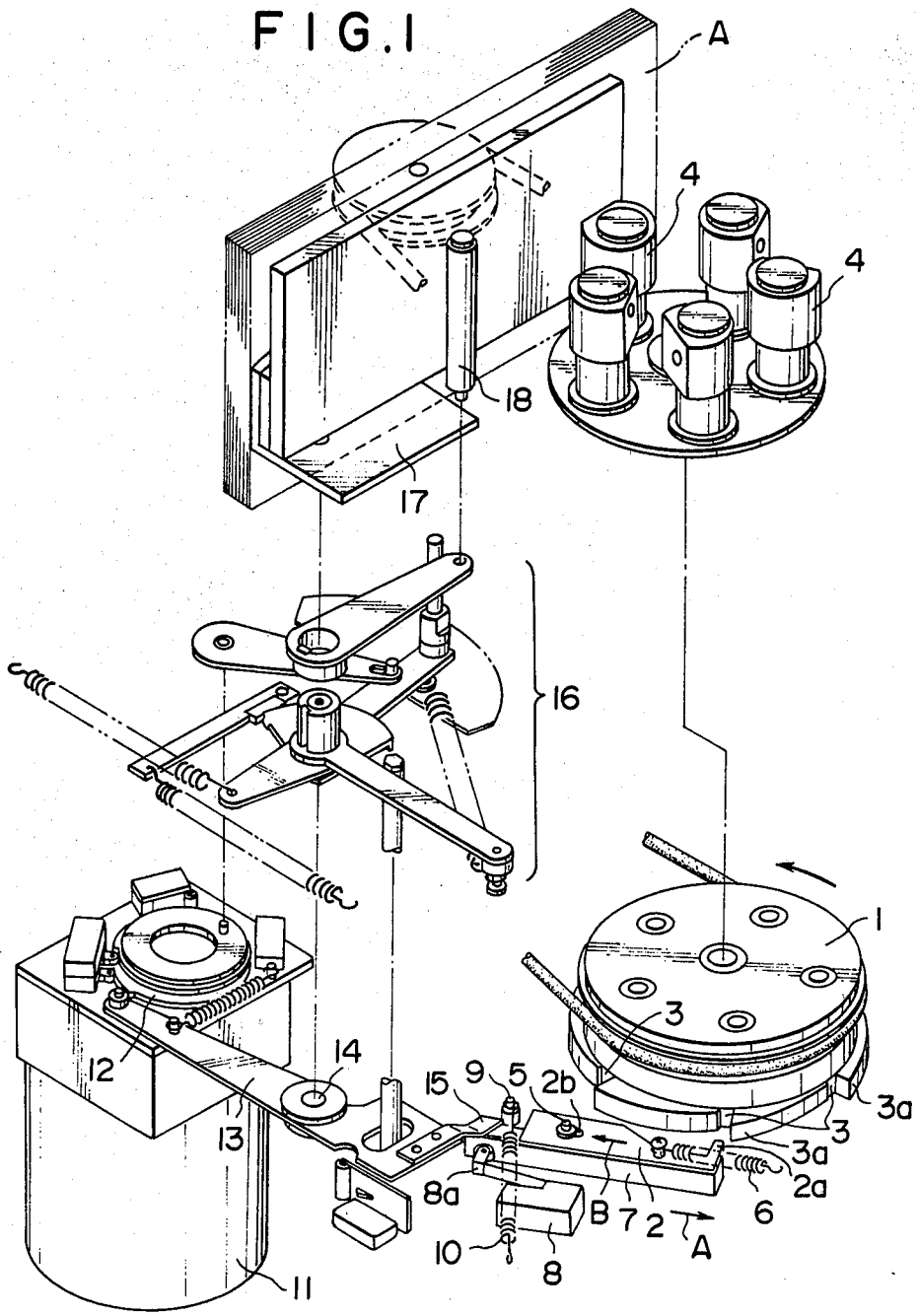
FIG. 1 is an exploded view of an embodiment perspectively showing main parts of the device according to the invention.

Firstly referring to FIG. 1 showing the main parts of the paper sheet counting apparatus according to the invention in the exploded form, a rotary cylinder 1 is rotated by a driving assembly, not shown. The rotary cylinder 1 has a peripheral face on which five equispaced recesses 3 are provided to engage with a pawl 2*a* of a stopper 2. At the left side, as viewed in FIG. 1, of each of the recesses 3, there is formed a slipping slope 3*a*. The number, five in this embodiment, of the engaging recesses 3 are equal to the number of suction heads 4 carried on the rotary cylinder 1, and each recess serves to stop the rotary cylinder 1 at a position at which each one of the suction heads 4 opposes to the face of the stacked paper sheets in the face-to-face relationship.

The stopper 2 may be made of an antifriction or abrasion-proof metal and has an elongated hole 2*b* extending along the longitudinal direction thereof. A shaft 5 secured to a base plate, not shown, is slidably inserted through the elongated hole 2a of the stopper 2. A clamper piece 5b for preventing the stopper 2 from slipping off from the shaft 5 is fixedly secured at the fore end of the shaft 5 through a washer 5a. The stopper 2 is biased in the direction shown by the arrow A in the Figure by the action of a coil spring 6 so that the shaft 5 is positioned at the one extremity of the elongated hole 2b. A side plate 7 is integrally formed at one edge of the stopper 2, and the outer face of the side plate 7 abuts against an actuator 8a of a microswitch 8 for detecting whether the pawl 2a of the stopper 2 engages with one of the engaging recesses 3 or not. On the other end of the stopper opposite to the end at which the pawl 2a is secured, there is provided a projecting stud 9 which is connected to a coil spring 10. By the resilient action of this tension coil spring 10, the stopper 2 is to be swinged about the shaft 5 in the counter-clockwise direction as viewed in the Figure.

The stopper 2 is positioned, as viewed in FIG. 1, against the spring action of the coil spring 10 with its pawl 2a to be separated from the peripheral face of the rotary cylinder 1 during the time period when the rotary cylinder 1 is rotated to allow the suction heads 4 to suck paper sheets to continue the counting operation. In detail, while the paper sheets are subjected to counting, the projecting stud 9 of the stopper 2 is pressed by a press member 15 secured at one end of a swingable arm 13 which is swinged about the axis 14 and urged to swing by the action of a cam plate 12 maintained at a predetermined position by a rotating holder motor 11. Reference numeral 16 designates a link mechanism for transferring a holder 17 and a paper press roller 18 or other related members for holding a bundle of paper sheets A to a paper sheet charging station, not shown. However, detailed description of these members will not be given herein, because the structure and operation thereof has been known in the art.

Figure 2:
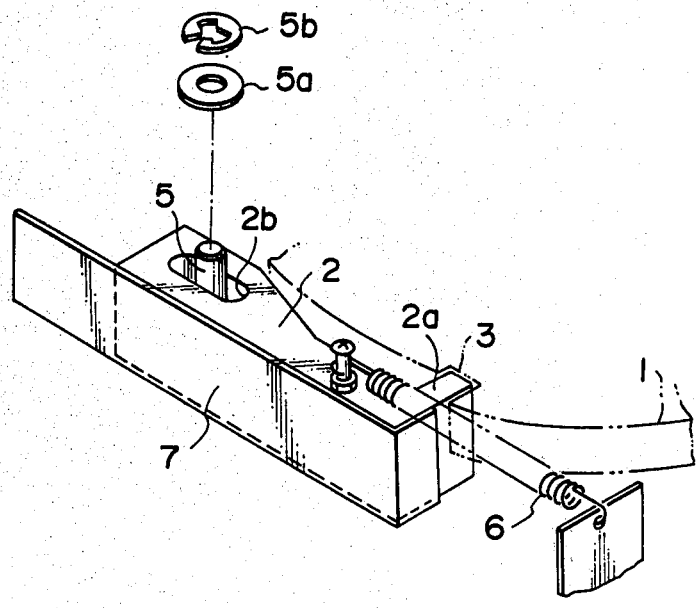
FIG. 2 is a perspective view showing the embodiment shown in FIG. 1.

The operation of the device according to the present invention will be described hereinafter. When the rotary cylinder 1 is driven to rotate, the paper sheets A held between the holder 4 and the press roller 18 are sucked by the suction heads 4 successively one by one to be counted. During this operation, the projecting stud 9 of the stopper 2 is pressed by the press member 15 of the swingable arm 13 to the position shown in FIG. 1 where the pawl 2a of the stopper 2 is separated from any of the engaging recesses 3 provided on the peripheral face of the rotary cylinder 1. After the counting operation for counting the paper sheets A is completed, a signal for stopping the driving motor, not shown, for the rotary cylinder 1 is generated to stop the rotational movement of the rotary cylinder 1. At the same time, a signal for actuating the holder motor 11 is generated to rotate the cam plate 12 by a pre-set angle. As the cam plate 12 is rotated by said pre-set angle, the swingable arm 13 is swinged about its swing shaft 14 in the clockwise direction to allow the press member 15 of the arm 13 to be separated from the projecting stud 9 of the stopper 2. As a result, the stopper 2 is swinged about the shaft 5 in the counter-clockwise direction under the action of the coil spring 10 so that the pawl 2a abuts against a portion of the peripheral face of the rotary cylinder 1, for instance a portion of a slipping slope 3a. However, when the pawl 2a of the stopper 2 abuts against one portion of one slipping slope 3a, any one of the suction heads 4 is not opposed precisely to the face of the bundle of paper sheets with its sucking port opposing in the face-to-face relationship to the face of the bundle of paper sheets. Such a positioning is undesirous in that the next cycle counting operation cannot be commenced immediately and correctively. To avoid stoppage of the suction heads 4 at the aforementioned undesirous positions, a signal for actuating the driving motor for driving the rotary cylinder 1 in the reverse direction is generated, whereupon the rotary cylinder 1 is rotated in the reverse direction, i.e. the clockwise direction in the Figure which is the direction reverse to the rotation direction thereof during the counting operation, at a relatively high speed. As the rotary cylinder 1 rotates in the clockwise direction, the pawl 2a of the stopper 2 slips down along the slipping slope 3a to fall in a recess 3 to stop rotational movement of the rotary cylinder 1 (see FIG. 2). Whereupon, the stopper 2 suffers a high impact or shock as a reaction force from the rotary cylinder 1.

However, in the device according to the present invention, the stopper 2 is damped by the spring action of the coil spring 6 and somewhat slides in the direction of the arrow B having its elongated hole guiding the shaft 5. The impact from the rotary cylinder 1 is effectively damped by this sliding movement. Hence, the crashing sound generated by the collision of the pawl 2a of the stopper 2 against the recess on the peripheral face of the rotary cylinder can be reduced. Furthermore, the engaging portions or contacting portions of the pawl and the recess are not subjected to a friction and impact forces of higher than the predetermined strength, since the stopper 2 can slide at some extent as mentioned hereinabove. Abrasion of the contacting portions are prevented by the aforementioned damping action by the coil spring 6.

Although the stopper 2 of the preceding embodiment is composed of an antifriction metal, the effects of suppressing the crashing sound and the abrasion prevention action can be further improved when the stopper is manufactured from a hard synthetic resin or a hard synthetic rubber material having the antifriction and abrasion-proof properties.

Figure 3:
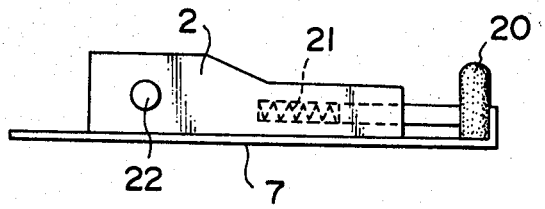
FIG. 3 is a plan view showing another embodiment according to the invention.

Referring now to FIG. 3 showing another embodiment of the present invention, the stopper 2 is rotatably attached to a shaft 22 which is secured to the base plate, not shown. A pawl 20 is provided on the stopper 2 so that the pawl is outwardly biased by an action of a spring 21 toward the folded portion of the side plate 7. It is preferable that the pawl 20 is made of a hard synthetic resin or a hard synthetic rubber and the other portions of the stopper 2 is made of a metal.

In the embodiment, when the rotary cylinder 1 is rotated in the clockwise direction after completion of the counting operation in a similar manner to the above-mentioned first embodiment, the impact from the rotary cylinder 1 is also effectively damped by the sliding movement of the pawl 20 against an action of the spring 21 while the stopper 2 is maintained to be stationary.

As will be apparent from the foregoing, the device of the present invention having the structure and function as aforementioned can effectively suppress the crashing sound generated when the stopper is struck against one of the engaging recesses, and further can prevent abrasion of the contacting portions. Nevertheless, a pawl is mounted integrally to the stopper which is provided with an elongated hole, and a shaft about which the stopper is swinged is fitted through the elongated hole so that the stopper can be slide relative to the shaft and at the same time the stopper can be swinged about the shaft moving relative to the shaft in the longitudinal direction of the stopper. With the construction mentioned just above, the device of the invention is simple in construction and can be easily manufactured.

Although the present invention has been described with reference to the specific embodiments thereof, it should be understood that various modifications, changes and variations will be anticipated in the light of the disclosure herein by a person having ordinary skill in the art without departing from the spirit and scope of the invention.

Accordingly, the foregoing disclosure should be interpreted as illustrative only and not to be interpreted in a limiting sense. The present invention is limited only by the appended claims.

What is claimed is:

1. A device for stopping the suction heads of a paper sheet counting apparatus at predetermined angular positions to be ready for immediately sucking the first sheet of the next cycle counting operation, comprising a rotary cylinder carrying a group of suction heads and having a peripheral face provided with engaging recesses each corresponding to each one of said suction heads to determine the angular positions of said suction heads when one cycle paper sheet counting operation is terminated and the rotary disk is stopped, a stopper having a pawl to be engaged with one of said recesses to stop and fix said rotary cylinder during the standstill time when said suction heads are to be stopped at predetermined angular position, said stopper having an elongated hole extending in the longitudinal direction thereof to receive a shaft about which said stopper is to be swinged, said stopper being movable relative to said shaft in the longitudinal direction within the extent defined by the length of said elongated hole, and a resilient member for damping the sliding movement of said stopper relative to said shaft when said pawl is engaged with one of said engaging recesses.

2. A device for stopping the suction heads of a paper sheet counting apparatus at predetermined angular positions to be ready for immediately sucking the first sheet of next cycle counting operation as set forth in claim 1, wherein said stopper is made of a hard synthetic resin material or a hard synthetic rubber material having antifriction and shock resistant properties.

* * * * *